US009103501B1

(12) United States Patent
Yang

(10) Patent No.: US 9,103,501 B1
(45) Date of Patent: Aug. 11, 2015

(54) GAS CYLINDER SAFETY PURGE AND ANCHOR SYSTEM

(71) Applicant: Cai Yang, Sacramento, CA (US)

(72) Inventor: Cai Yang, Sacramento, CA (US)

( * ) Notice: Subject to any disclaimer, the term of this patent is extended or adjusted under 35 U.S.C. 154(b) by 188 days.

(21) Appl. No.: 13/938,794

(22) Filed: Jul. 10, 2013

(51) Int. Cl.
*F17C 13/00* (2006.01)

(52) U.S. Cl.
CPC ..... *F17C 13/002* (2013.01)

(58) Field of Classification Search
CPC ..... F17C 2205/0394; F17C 2205/0388; F17C 2205/0338; F17C 2205/0332; F17C 2205/0323; F17C 13/123; F17C 13/12; F17C 13/06; F17C 13/04
USPC ..... 251/324–325, 319, 291; 220/581, 583, 220/203.19, 203.01, 0.7, 0.6; 137/505.42, 137/505, 240, 238, 234.5; 124/770–74
See application file for complete search history.

(56) References Cited

U.S. PATENT DOCUMENTS

| | | | | | |
|---|---|---|---|---|---|
| 4,737,320 | A | | 4/1988 | Rothschild | |
| 5,165,565 | A | * | 11/1992 | Schlessmann et al. | 220/304 |
| 5,421,380 | A | * | 6/1995 | Campbell | 141/65 |
| 5,638,858 | A | | 6/1997 | Gettinger et al. | |
| 5,996,625 | A | * | 12/1999 | Collado et al. | 137/614.19 |
| 6,079,582 | A | * | 6/2000 | Nickel et al. | 220/238 |
| 6,173,855 | B1 | * | 1/2001 | Stark | 220/295 |
| 6,209,749 | B1 | | 4/2001 | Guess | |
| 6,478,046 | B2 | * | 11/2002 | Gabrel | 137/505.42 |
| 6,899,125 | B2 | * | 5/2005 | Ellero et al. | 137/505.42 |
| 8,210,160 | B2 | * | 7/2012 | Wood | 124/73 |
| 2003/0034021 | A1 | * | 2/2003 | Gabrel | 124/71 |
| 2004/0040552 | A1 | | 3/2004 | Ho | |
| 2004/0194835 | A1 | * | 10/2004 | Gabrel | 137/625.69 |
| 2006/0005884 | A1 | * | 1/2006 | Gabrel | 137/505.41 |
| 2006/0249132 | A1 | * | 11/2006 | Gabrel | 124/70 |
| 2008/0210210 | A1 | * | 9/2008 | Colby | 124/73 |
| 2009/0032133 | A1 | * | 2/2009 | Abe | 141/2 |
| 2009/0078321 | A1 | * | 3/2009 | Arnott et al. | 137/14 |
| 2009/0229591 | A1 | * | 9/2009 | Gabrel | 124/73 |
| 2010/0243681 | A1 | * | 9/2010 | Abe et al. | 222/402.25 |

* cited by examiner

*Primary Examiner* — Anthony Stashick
*Assistant Examiner* — Kaushikkumar Desai

(57) ABSTRACT

A gas cylinder safety purge and anchor system features a gas cylinder with a plurality of cylinder apertures located around a neck outside periphery. The system features a cylindrical purge deflector with a plurality of deflector apertures located on a internal deflector cap component wall that align with the cylinder apertures when the purge deflector is positioned on the neck. The system features a valve on the cylinder. The system features an anchor assembly having a linear outer tube and a linear inner shaft located in the outer tube. In a first position, a first anchor projection, a second anchor projection, a third anchor projection, and a fourth anchor projection are each located perpendicularly with respect to the outer tube. In a second position, the first anchor projection, the second anchor projection, the third anchor projection, and the fourth anchor projection are each retracted.

1 Claim, 3 Drawing Sheets

GAS CYLINDER SAFETY PURGE AND ANCHOR SYSTEM

FIELD OF THE INVENTION

The present invention relates to compressed gas systems, or more specifically compressed gas systems for use with paint ball equipment.

BACKGROUND OF THE INVENTION

Paint ball is a popular game using a paint ball marker (gun) for propelling a color dyed projectile toward an opponent to "tag" them. The paint ball marker uses compressed gas as a means for propulsion. The compressed gas is stored in a cylindrical tank mounted to the paint ball marker. Some cylindrical tanks can be recharged with air or carbon dioxide. The present invention features a gas cylinder safety purge and anchor system to facilitate convenience and improve safety when refilling gas cylinders.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY OF THE INVENTION

A gas cylinder safety purge and anchor system comprises a gas cylinder having an internally threaded neck. In some embodiments, a plurality of cylinder apertures is located around a neck outside periphery and fluidly connected to an internal chamber.

In some embodiments, the system comprises a cylindrical purge deflector having an internal deflector cap component and an external deflector cap component. In some embodiments, the internal deflector cap component comprises a plurality of deflector apertures located on an internal deflector cap component wall. In some embodiments, the deflector apertures align with the cylinder apertures when the purge deflector is located on the neck. In some embodiments, the system comprises a valve having a valve posterior end threadably attached to a cylinder anterior end. In some embodiments, a plurality of purge release holes is located on a valve wall close to a valve posterior end.

In some embodiments, the system comprises an anchor assembly having a linear outer tube and a linear inner shaft located in the outer tube. In some embodiments, in a first position, an inner shaft operating lever is located in a posterior-most position. In some embodiments, a first anchor projection, a second anchor projection, a third anchor projection, and a fourth anchor projection are each located perpendicularly with respect to the outer tube. In some embodiments, in a second position, the inner shaft operating lever is located in an anterior-most position. In some embodiments, the first anchor projection, the second anchor projection, the third anchor projection, and the fourth anchor projection are each retracted. In some embodiments, each anchor projection comprises a length greater than a neck inner diameter. In some embodiments, each anchor projection comprises a length less than a cylinder inner diameter. In some embodiments, the anchor assembly is attached to the valve posterior end via a spiral cord.

DESCRIPTION OF PREFERRED EMBODIMENTS

Figure 1:
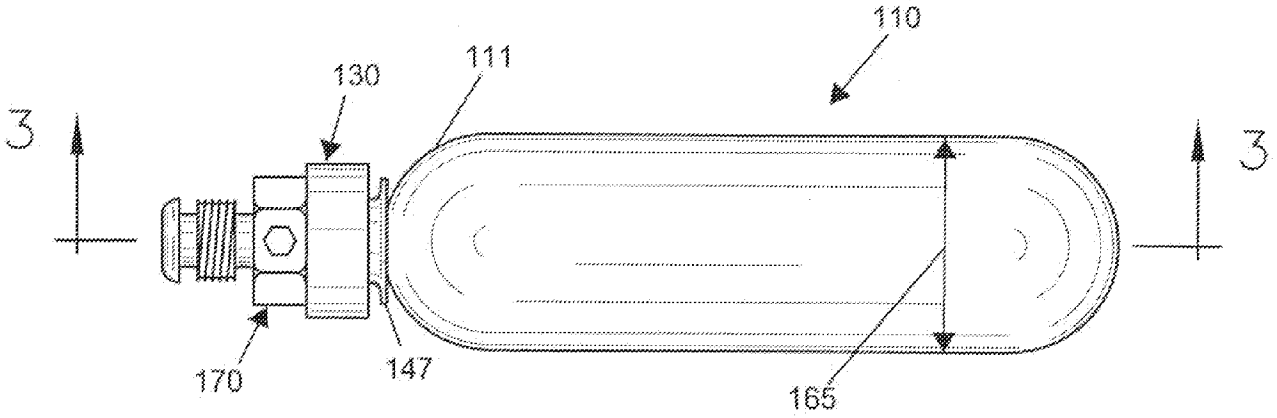
FIG. 1 shows a side view of the gas cylinder of the present invention.

Following is a list of elements corresponding to a particular element referred to herein:

100 Gas cylinder safety purge and anchor system
110 Gas cylinder
111 Cylinder anterior end
114 Internal chamber
115 Neck
116 Neck outside periphery
120 Cylinder aperture
130 Purge deflector
140 Internal deflector cap component
141 Internal deflector anterior end
143 Internal deflector aperture
144 Internal deflector aperture outer periphery
145 Internal deflector wall
146 Internal deflector posterior end
147 Radial flare
149 Deflector aperture
150 External deflector cap component
151 External deflector anterior end
152 External deflector anterior end outer periphery
153 External deflector aperture
154 External deflector skirt
160 Internal deflector aperture diameter
161 External deflector aperture diameter
162 Internal deflector wall inner diameter
163 Neck outer diameter
164 Neck inner diameter
165 Cylinder inner diameter
170 Valve
171 Valve posterior end
172 Valve wall
173 Purge release hole
175 Anchor assembly
180 Outer tube
182 Outer tube posterior end
183 Outer tube slot
185 First anchor projection
186 Second anchor projection
187 Third anchor projection
188 Fourth anchor projection
190 Inner shaft
191 Inner shaft anterior end
192 Inner shaft posterior end
194 Inner shaft operating lever
195 First pivoting rod
196 First pivoting rod first end
197 First pivoting rod second end
205 Second pivoting rod

Figure 2:
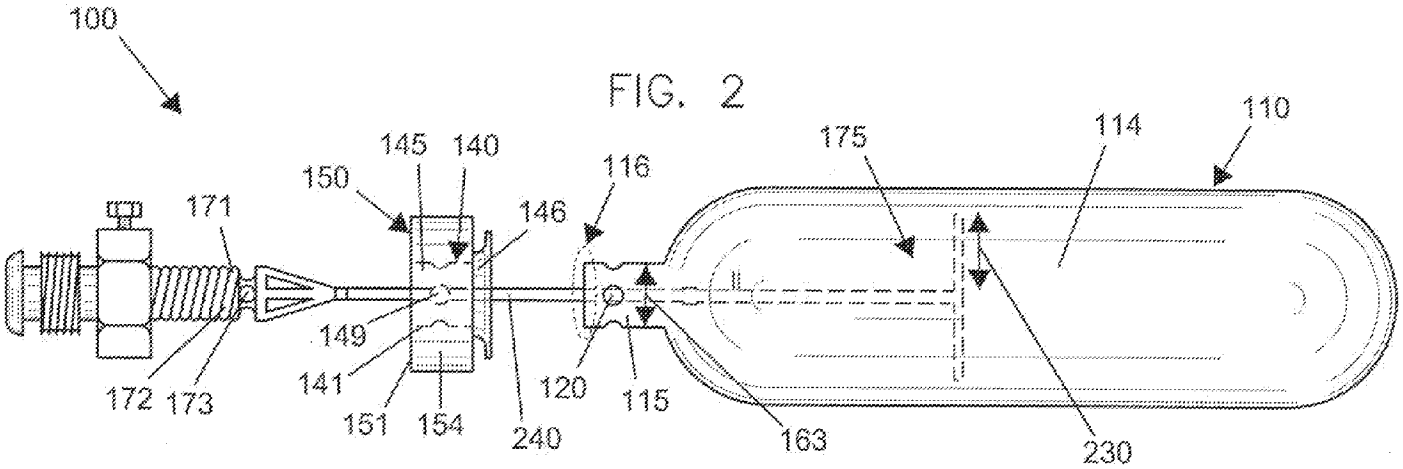
FIG. 2 shows an exploded side view of the present invention.
Figure 3:
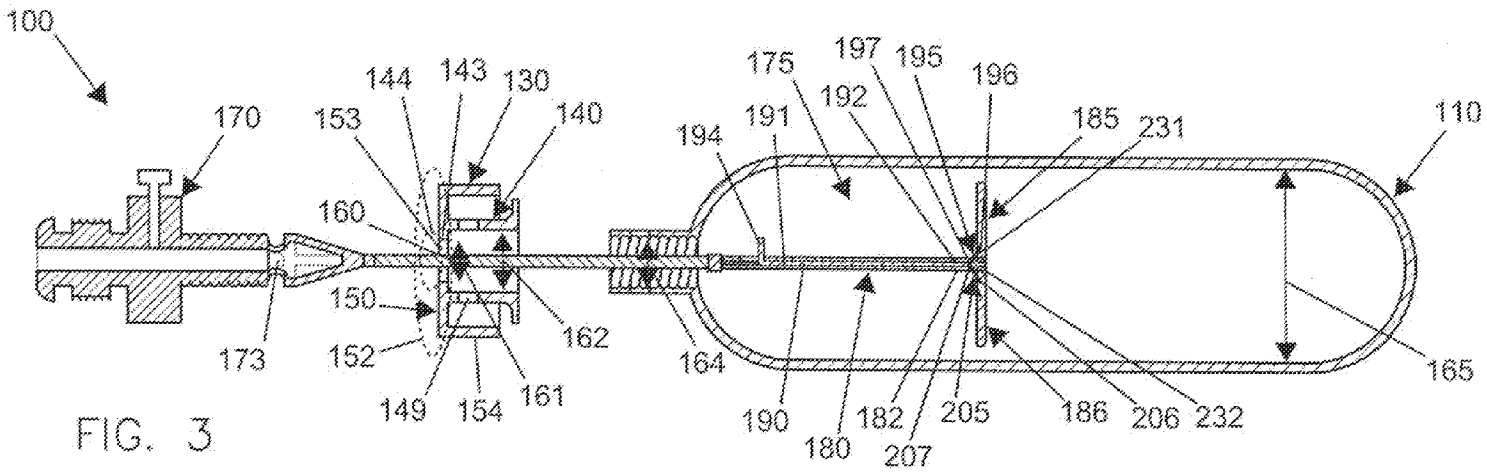
FIG. 3 shows a cross-section of the present invention in a sagittal plane.
Figure 5:
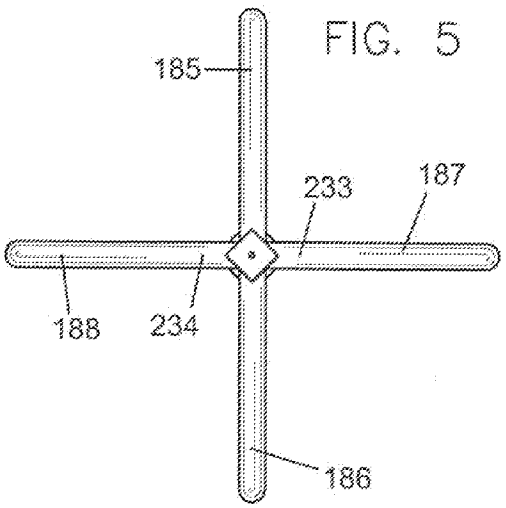
FIG. 5 shows a bottom view of the anchor assembly of the present invention.
Figure 4:
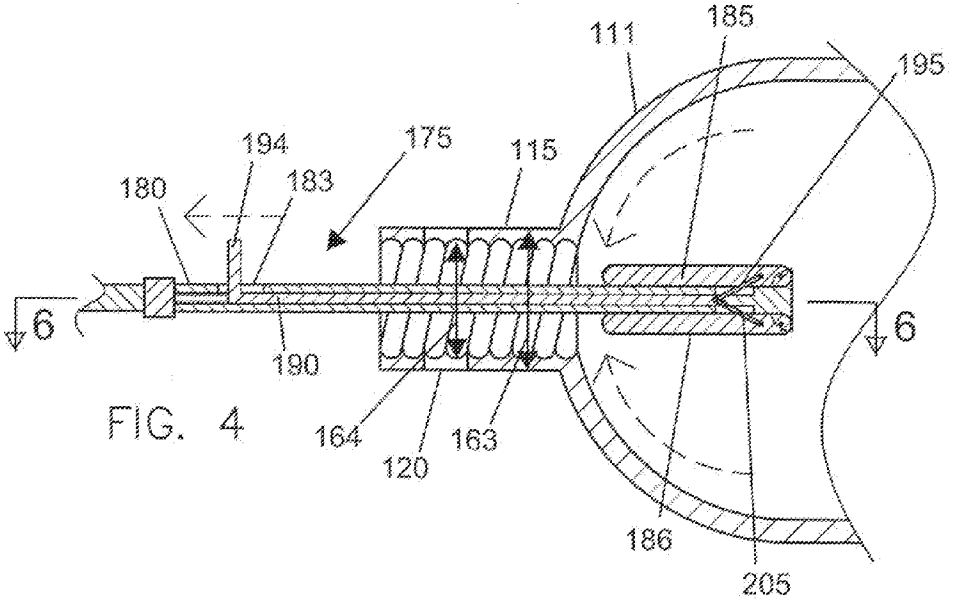
FIG. 4 shows a close up view of a cross-section of the present invention in a sagittal plane.
Figure 6:
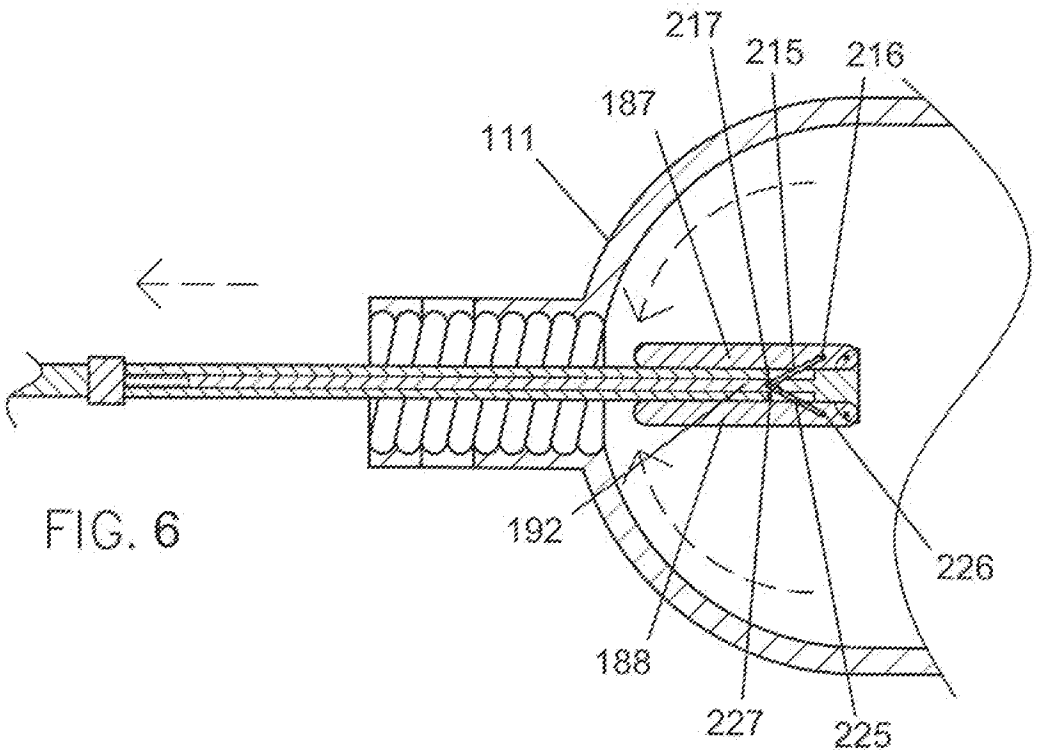
FIG. 6 shows a close up view of a cross-section of the present invention in a sagittal plane.

206 Second pivoting rod first end
207 Second pivoting rod second end
215 Third pivoting rod
216 Third pivoting rod first end
217 Third pivoting rod second end
225 Fourth pivoting rod
226 Fourth pivoting rod first end
227 Fourth pivoting rod second end
230 Anchor projection length
231 First anchor projection first end
232 Second anchor projection first end
233 Third anchor projection first end
234 Fourth anchor projection first end
240 Spiral cord Referring now to FIG. 1-6, the present invention features a gas cylinder safety purge and anchor system (100). In some embodiments, the system (100) comprises a gas cylinder (110) having a cylinder anterior end (111) with an internally threaded neck (115) located thereon. In some embodiments, a plurality of cylinder apertures (120) is located around a neck outside periphery (116) and fluidly connected to an internal chamber (114).

In some embodiments, the system (100) comprises a cylindrical purge deflector (130) having an internal deflector cap component (140) and an external deflector cap component (150). In some embodiments, the external deflector cap component (150) comprises a planar external deflector anterior end (151) having an external deflector aperture (153) centrally located thereon and a cylindrical external deflector skirt (154) perpendicularly projecting from an external deflector anterior end outer periphery (152).

In some embodiments, the internal deflector cap component (140) comprises an internal deflector anterior end (141) having an internal deflector aperture (143) centrally located thereon and a cylindrical internal deflector wall (145) perpendicularly projecting from an internal deflector aperture outer periphery (144). In some embodiments, the internal deflector anterior end (141) is located on the external deflector anterior end (151).

In some embodiments, the internal deflector cap component (140) comprises a plurality of deflector apertures (149) located on the internal deflector wall (145). In some embodiments, the deflector apertures (149) align with the cylinder apertures (120) when the purge deflector (130) is located on the neck (115). In some embodiments, an internal deflector posterior end (146) comprises a radial flare (147).

In some embodiments, an internal deflector aperture diameter (160) and an external deflector aperture diameter (161) are equal. In some embodiments, an internal deflector wall inner diameter (162) and a neck outer diameter (163) are equal.

In some embodiments, the system (100) comprises a valve (170) having a valve posterior end (171) threadably located on the cylinder anterior end (111). In some embodiments, a plurality of purge release holes (173) is located on a valve wall (172) close to the valve posterior end (171).

In some embodiments, the system (100) comprises an anchor assembly (175) having a linear outer tube (180) and a linear inner shaft (190) slidably located in the outer tube (180). In some embodiments, a first anchor projection (185) is pivotally located on an outer tube posterior end (182). In some embodiments, a second anchor projection (186) is pivotally located on the outer tube posterior end (182) opposed to the first anchor projection (185). In some embodiments, a third anchor projection (187) is pivotally located on the outer tube posterior end (182) between the first anchor projection (185) and the second anchor projection (186). In some embodiments, a fourth anchor projection (188) is pivotally located on the outer tube posterior end (182) opposed to the third anchor projection (187).

In some embodiments, a first pivoting rod first end (196) is located close to a first anchor projection first end (231) and a first pivoting rod second end (197) is located on an inner shaft posterior end (192). In some embodiments, a second pivoting rod first end (206) is located close to a second anchor projection first end (232) and a second pivoting rod second end (207) is located on the inner shaft posterior end (192). In some embodiments, a third pivoting rod first end (216) is located close to a third anchor projection first end (233) and a third pivoting rod second end (217) is located on the inner shaft posterior end (192). In some embodiments, a fourth pivoting rod first end (226) is located close to a fourth anchor projection first end (234) and a fourth pivoting rod second end (227) is located on the inner shaft posterior end (192).

In some embodiments, an inner shaft operating lever (194) is perpendicularly located on an inner shaft anterior end (191) and projects through an outer tube slot (183).

In some embodiments, in a first position, the inner shaft operating lever (194) is moved to and located in a posteriormost position. In some embodiments, the first anchor projection (185), the second anchor projection (186), the third anchor projection (187), and the fourth anchor projection (188) are each located perpendicularly with respect to the outer tube (180).

In some embodiments, in a second position, the inner shaft operating lever (194) is moved to and located in an anteriormost position. In some embodiments, the first anchor projection (185), the second anchor projection (186), the third anchor projection (187), and the fourth anchor projection (188) are each retracted via the inner shaft (190) moving a first pivoting rod (195), a second pivoting rod (205), a third pivoting rod (215), and a fourth pivoting rod (225). In some embodiments, the first anchor projection (185), the second anchor projection (186), the third anchor projection (187), and the fourth anchor projection (188) are each located parallel with respect to the outer tube (180).

In some embodiments, each anchor projection comprises an anchor projection length (230) greater than a neck inner diameter (164). In some embodiments, each anchor projection comprises a length less than the cylinder inner diameter (165). In some embodiments, each anchor projection comprises a length less than one half the cylinder inner diameter (165). In some embodiments, the anchor assembly (175) is located on the valve posterior end (171) via a flexible spiral cord (240).

In some embodiments, the purge deflector (130) is adapted to deflect and dissipate gas during purging. In some embodiments, the anchor assembly (175) is adapted to prevent the valve (170) becoming a projectile upon removal from the gas cylinder (110).

As used herein, the term "about" refers to plus or minus 10% of the referenced number.

The disclosures of the following U.S. Patents are incorporated in their entirety by reference herein: U.S. Patent Pub. No. 2004/0040552; U.S. Pat. No. 6,209,749; U.S. Pat. No. 6,173,855; U.S. Pat. No. 6,079,582; U.S. Pat. No. 5,638,858; and U.S. Pat. No. 4,737,320.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims. Reference numbers recited in the claims are exemplary and for ease of review by the patent office only, and are not limiting in any way.

The reference numbers recited in the below claims are solely for ease of examination of this patent application, and are exemplary, and are not intended in any way to limit the scope of the claims to the particular features having the corresponding reference numbers in the drawings.

What is claimed is:

1. A gas cylinder safety purge and anchor system (100), wherein the system (100) comprises:

(a) a gas cylinder (110) having a cylinder anterior end (111) with an internally threaded neck (115) disposed thereon, wherein a plurality of cylinder apertures (120) is disposed around a neck outside periphery (116) and fluidly connected to an internal chamber (114);

(b) a cylindrical purge deflector (130) having an internal deflector cap component (140) and an external deflector cap component (150), wherein the external deflector cap component (150) comprises a planar external deflector anterior end (151) having an external deflector aperture (153) centrally disposed thereon and a cylindrical external deflector skirt (154) perpendicularly projecting from an external deflector anterior end outer periphery (152).

wherein the internal deflector cap component (140) comprises an internal deflector anterior end (141) having an internal deflector aperture (143) centrally disposed thereon and a cylindrical internal deflector wall (145) perpendicularly projecting from an internal deflector aperture outer periphery (144), wherein the internal deflector anterior end (141) is disposed on the external deflector anterior end (151), wherein the internal deflector cap component (140) comprises a plurality of deflector apertures (149) disposed on the internal deflector wall (145), wherein the deflector apertures (149) align with the cylinder apertures (120) when the purge deflector (130) is disposed on the neck (115), wherein an internal deflector posterior end (146) comprises a radial flare (147), wherein an internal deflector aperture diameter (160) and an external deflector aperture diameter (161) are equal, wherein an internal deflector wall inner diameter (162) and a neck outer diameter (163) are equal;

(c) a valve (170) having a valve posterior end (171) threadably disposed on the cylinder anterior end (111), wherein a plurality of purge release holes (173) are disposed on a valve wall (172) proximal to the valve posterior end (171); and (d) an anchor assembly (175) having a linear outer tube (180) and a linear inner shaft (190) slidably disposed in the outer tube (180), wherein a first anchor projection (185) is pivotally disposed on an outer tube posterior end (182), wherein a second anchor projection (186) is pivotally disposed on the outer tube posterior end (182) opposed to the first anchor projection (185), wherein a third anchor projection (187) is pivotally disposed on the outer tube posterior end (182) between the first anchor projection (185) and the second anchor projection (186), wherein a fourth anchor projection (188) is pivotally disposed on the outer tube posterior end (182) opposed to the third anchor projection (187), wherein a first pivoting rod first end (196) is disposed proximal to a first anchor projection first end (231) and a first pivoting rod second end (197) is disposed on an inner shaft posterior end (192), wherein a second pivoting rod first end (206) is disposed proximal to a second anchor projection first end (232) and a second pivoting rod second end (207) is disposed on the inner shaft posterior end (192), wherein a third pivoting rod first end (216) is disposed proximal to a third anchor projection first end (233) and a third pivoting rod second end (217) is disposed on the inner shaft posterior end (192), wherein a fourth pivoting rod first end (226) is disposed proximal to a fourth anchor projection first end (234) and a fourth pivoting rod second end (227) is disposed on the inner shaft posterior end (192), wherein an inner shaft operating lever (194) is perpendicularly disposed on an inner shaft anterior end (191) and projects through an outer tube slot (183), wherein in a first position, the inner shaft operating lever (194) is disposed in a posterior-most position, wherein the first anchor projection (185), the second anchor projection (186), the third anchor projection (187), and the fourth anchor projection (188) are each disposed perpendicularly with respect to the outer tube (180), wherein in a second position, the inner shaft operating lever (194) is disposed in an anterior-most position, wherein the first anchor projection (185), the second anchor projection (186), the third anchor projection (187), and the fourth anchor projection (188) are each retracted via the inner shaft (190) disposing a first pivoting rod (195), a second pivoting rod (205), a third pivoting rod (215), and a fourth pivoting rod (225), wherein the first anchor projection (185), the second anchor projection (186), the third anchor projection (187), and the fourth anchor projection (188) are each disposed parallel with respect to the outer tube (180), wherein each anchor projection comprises an anchor projection length (230) greater than a neck inner diameter (164), wherein each anchor projection comprises a length less than the cylinder inner diameter (165), wherein the anchor assembly (175) is disposed on the valve posterior end (171) via a spiral cord (240);

wherein the purge deflector (130) is adapted to deflect and dissipate gas during purging, wherein the anchor assembly (175) is adapted to prevent the valve (170) becoming a projectile upon removal from the gas cylinder (110).

* * * * *